United States Patent [19]

Wagner et al.

[11] 4,305,683

[45] Dec. 15, 1981

[54] TUBULAR ELEMENT FOR TUNNEL CONSTRUCTION

[76] Inventors: Harald Wagner, Lehmweg 11a, 6020 Innsbruck-Arzl; Friedrich K. Blindow, Hohenstr. 67, 6020 Innsbruck, both of Austria; Heinz Distelmeier, Laberstr. 4, D-8021 Deining, Fed. Rep. of Germany; Alfred Schulter, Waldgasse 11, 8055 Neuseiersberg, Austria

[21] Appl. No.: 30,290

[22] Filed: Apr. 16, 1979

Related U.S. Application Data

[63] Continuation-in-part of Ser. No. 3,026, Jan. 12, 1979, abandoned.

[51] Int. Cl.[3] ..... E21D 11/04

[52] U.S. Cl. ..... 405/132; 405/151

[58] Field of Search ..... 405/132, 134, 135, 150, 405/151, 152, 153; 52/20, 245, 574, 575; 138/155, 177

[56] References Cited

U.S. PATENT DOCUMENTS

| | | | |
|---|---|---|---|
| 1,363,115 | 12/1920 | Helfrich | 405/135 |
| 1,923,006 | 8/1933 | Proctor | 405/152 |
| 2,002,127 | 5/1935 | O'Neal | 52/20 |
| 3,818,710 | 6/1974 | Chlumecky | 405/152 |
| 4,047,388 | 9/1977 | Howlett | 405/135 |
| 4,070,866 | 1/1978 | Juvrud | 405/152 |

FOREIGN PATENT DOCUMENTS

| | | | |
|---|---|---|---|
| 309513 | 8/1973 | Austria . | |
| 562888 | 10/1932 | Fed. Rep. of Germany | 405/134 |

*Primary Examiner*—David H. Corbin

*Attorney, Agent, or Firm*—Ernest F. Marmorek

[57] ABSTRACT

A hollow tube element of a predetermined maximal width and defining a predetermined axis adapted to be secured to an adjoining hollow element defines a prearranged axis for use as building blocks for the construction of a tunnel; either element is rotatable about its axis by an arbitrary angle relative to the other. The hollow tube element includes a plurality of interconnected slabs; the locus of intersection of an imaginary first plane tangential to a first exterior portion of the hollow tube element with an imaginary second plane, and tangential to a second exterior portion of said hollow tube element disposed opposite the first portion, both plates having the predetermined width, is an imaginary annular surface having a predetermined outer diameter when either element is rotated 360° about its axis relative to the other. The outer diameter is finite when the planes are converging at a finite distance from the element, and otherwise infinite.

15 Claims, 29 Drawing Figures

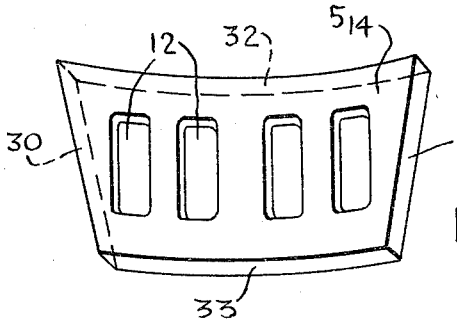
FIG 25
FIG 26
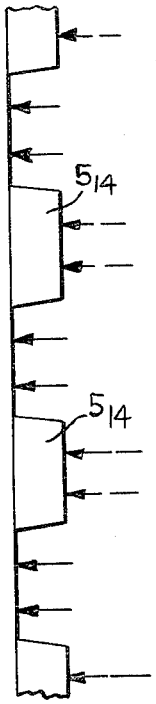
FIG 27
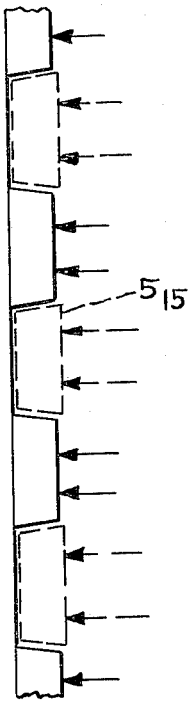
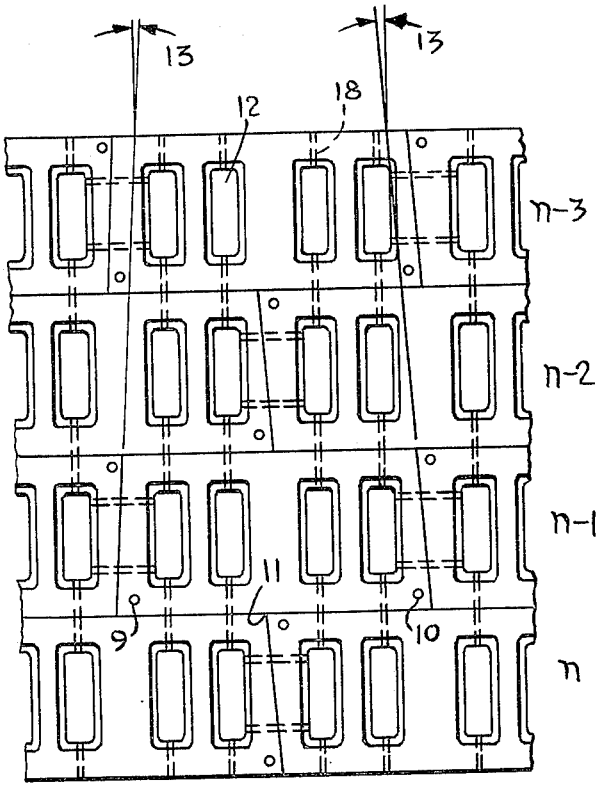
FIG 28
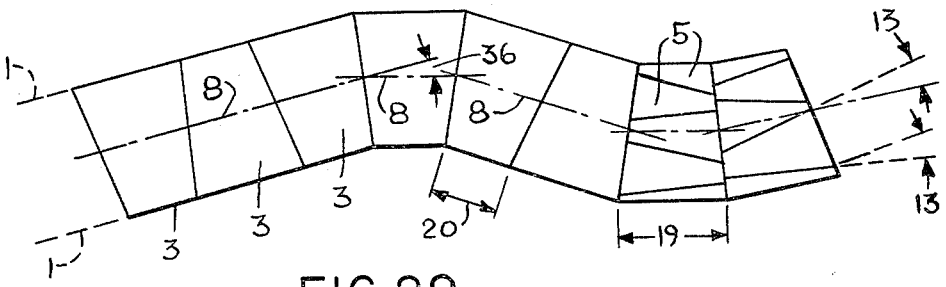
FIG 29

TUBULAR ELEMENT FOR TUNNEL CONSTRUCTION

CROSS-REFERENCES TO RELATED APPLICATIONS

This application is a continuation-in-part application of application Ser. No. 003,026 filed on Jan. 12, 1979, now abandoned.

BACKGROUND OF THE INVENTION

A very good description of the prior art appears in the textbook, "K. Széchy, Tunnelbau"—1969, Springer Verlag, Vienna—New York, pages 686 through 697 (in German).

It is a specific disadvantage of the prior art that if it is desired to lay out a tunnel, which must follow a predetermined spatial curve, which may include uphill and downhill portions, or portions going to the right or the left, a special matching section has to be provided, which requires mating with receiving and following sections of the tunnel. This has been achieved primarily by employing conically-truncated rings, as matching pieces. In view of unavoidable constructual deviations from those planned during the forward motion of the propelling shield, the number and the placement of the conically-truncated rings could not be planned exactly in advance. The combination of parallel cylindrical rings with truncated cylinders or cones required a correspondingly large number of pipe sections and conduits forms, and in turn resulted in a large storage of all types of pipes, including associated constructual parts.

Both the prior art systems and the system according to the present invention, require means to prevent surface subsidence.

Methods to prevent such subsidence are discussed in "Tunnelling Technology", an appraisal of the state of the art for application to transit systems, published by the Ministry of Transportation and Communications of Canada, in 1976. Of particular interest is Section 6, pages 96 and 97, the applicable portions of which are briefly summarized below.

One method of preventing surface subsidence is grouting or caulking. When proper workmanship is carried out, the effect of potential ground subsidence can be minimized.

Backfilling and grouting operations can have several functions including: (i) stabilization of the surrounding ground, thus reducing possible ground-pressure on the lining; (ii) sealing of the ground against water; and (iii) establishment of a tight backfill to minimize distortion and subsidence.

These functions are not normally carried out by the same construction operation. Primary grouting is intended to fill the void space and to develop a tight backfill. It is normally carried out under low pressures of 70 to 80 pounds per square inch. Secondary grouting is used to stabilize the ground and reduce seepage and usually requires a pressure of at least 160 pounds per square inch.

For primary grouting, a fairly wet cement grout can be used by injecting through grout pluds in the lining as the tail shield clears them. However, this system has disadvantages in that large quantities of cement are required, and if the grout is too liquid, it will flow around the segments and interfere with the shield. The quantity of cement can be reduced by the use of pea gravel which is blown into the annular space first before the cement grout. This is done by means of special equipment which operates under the same air pressures required for the cement grouting.

Depending upon the stand-up time, the primary grouting may have to be carried out shortly after the shield has advanced. Under adverse conditions, the pea gravel may have to be introduced immediately to minimize the potential ground movement and thus an additional construction operation must be included at the tunnel face and within the critical path. Unless the operation is carefully controlled, the rate of advance will decrease and an increase in the cost of construction will result. If there is sufficient stand-up time, the grouting may be delayed until the maintenance period for servicing the excavating equipment.

Secondary grouting for sealing and stabilization should either be carried out in advance of the excavation process, or several months after primary grouting, when the ground conditions have achieved equilibrium. In the latter case, the grouting pressures must be carefully checked for the development of excess pressures and non-uniform loading on the completed tunnel lining. The highest pressures that can be used will be related to the depth of overburden and the permissible deformations of the lining. In many cases, these limiting pressures will be below those necessary to force the grout into very fine soils.

To control seepage into the tunnel, it is necessary to incorporate caulking grooves in the tunnel segments, and to fill the spaces with caulking compounds of asbestos cement, hemp or lead. With carefully constructed lining segments, the amount of seepage is relatively minor so that the caulking operations can usually be carried out at a convenient later stage in the construction program.

Another method of preventing surface subsidence is the use of extruded and slipform tunnel lining systems. Slipforming is applicable to both rock and soft ground tunnelling conditions, although the method of operating the tunnel boring machine (TBM) equipment and the jacking sequences would have to be different for each of these main ground classifications.

The ideal material for use in forming an extruded liner should possess the following properties: It should (i) be chemically stable and non-toxic; (ii) be pumpable; (iii) solidify rapidly with little volume change under controlled rates of setting; (iv) exhibit a rapid gain in strength; (v) gain strength with time; (vi) be dimensionally stable; (vii) be corrosion resistant; and (viii) be low in overall economic cost.

SUMMARY OF THE INVENTION

It is therefore the task of the present invention to develop a pipe ring from reinforced concrete, which permits the attainment of any spatially desired tunnel curve, using a single standardized hollow pipe ring.

This is attained, according to the present invention, by providing a hollow tube element of a predetermined maximal width and defining a predetermined axis adapted to be secured to an adjoining hollow element defining a prearranged axis for use as building blocks for the construction of a tunnel, either element being rotatable about its axis by an arbitrary angle relative to the other; the hollow tube element includes a plurality of interconnected slabs, the locus of intersection of an imaginary first plane tangential to a first exterior portion of the hollow tube element with an imaginary second plane, and tangential to a second exterior portion of the hollow tube element disposed opposite the first portion, both planes having the predetermined width, being an imaginary annular surface having a predetermined outer diameter when either element is rotated 360° about its axis relative to the other. The outer diameter is finite when the planes are converging at a finite distance from the element, and is otherwise infinite.

It is advantageous if the locus is defined as the imaginary annular surface, when the exterior portions of either element are rotated about the respective element's axis.

The hollow tube element may be a cylinder, or a truncated cone, and the predetermined axis is advantageously a central axis.

It is advantageous if the adjoining tube element is similar to the hollow tube element, and if each slab in the hollow tube element differs dimensionally from at least one other slab.

The number of slabs differing from one another in the adjoining tube element is at most equal to the number of slabs differing from one another in the hollow tube element.

The slabs advantageously include first and second groups, and each of the slabs has preferably two peripherally-facing end surfaces forming an acute angle with one another, and two axially-facing end surfaces disposed opposite one another. The peripherally-facing end surfaces of the first and second groups of slabs converge in respective opposite directions; first and second predetermined conicities with respect to a radial direction of a corresponding slab of the first and second groups, respectively, are defined by an imaginary cone having a cone axis passing through the predetermined axis, which has a circumferential surface portion inscribed between the two peripherally-facing end surfaces and one of the axially-facing end surfaces of a corresponding slab; the two peripherally-facing end surfaces converge on one side of a corresponding slab to a line of intersection facing away from the cone; one of the axially-facing end surfaces of the corresponding slab faces the line of intersection.

In one version of the invention, the first and second conicities are substantially equal.

In another version of the invention, the apex of one cone is located outside the hollow tube element, and the apex of the other cone is located inside the hollow tube element.

In still another version of the invention, the apices of the cones are located substantially on the inner circumference of the hollow tube element.

In a preferred version of the invention, the first predetermined conicity subtends a solid angle of about 18°, and the second predetermined conicity subtends a solid angle of about 36°.

The acute angle of a slab of the first group of slabs is preferably within the range of 0.1 to 3 degrees, and the acute angle of the second group of slabs is preferably within the range of 0.2 to 6 degrees.

It is advantageous if each of the slabs has a plurality of recesses on an inner side thereof.

It is particularly advantageous if each of the slabs has a plurality of corners, and an opening near at least one of the corners, so that hardenable material in liquid form can be extruded from the interior of the hollow tube element towards its exterior, so as to form a securing link between the hollow tube element and earth surrounding the hollow tube element after installation of the hollow tube element in the earth, and following hardening of the liquid material.

It is advantageous to provide each slab with threaded holes on opposite axial sides thereof, and these should be arranged so that upon rotation of the tube element by an integral multiple of 180°, threaded holes of juxtaposed tube elements are aligned.

The present invention can alternately be defined as a hollow member having an inner surface defined by the rotation of a tetragon about one side thereof, that side defining an axis of rotation; the hollow member has preferably two ends defining respective planes, and at least one of the planes is preferably disposed at an angle other than a right angle to the axis of rotation. The hollow member is adapted to be secured to a similar adjoining member, defining a prearranged axis, and the members are then used as building blocks in the construction of a tunnel. The adjoining member is adapted to be selectively oriented in relation to the hollow member, so that one end of the hollow member is juxtaposed with one end of the adjoining member, permitting one of the members to be rotated by an arbitrary angle relative to the other.

The axes subtend a prearranged angle with one another in dependence of the selected orientation of the adjoining member in relation to the hollow member.

The prearranged angle is preferably within the range of zero degrees to about 6 degrees. The hollow member includes a plurality of interconnected slabs.

The present invention also encompasses a tunnel construction, including a multiplicity of interconnected hollow members defining a tunnel passage; each hollow member defines a perdetermined axis, and includes means for selectively orienting an adjoining member in relation to the hollow member, so that the axis of the hollow member subtends a prearranged angle with the axis of the adjoining member in dependence of the selected orientation of the adjoining member, thus permitting pre-selection of a spatial tunnel path, in accordance with successive selections of the prearranged angle between the axis of the member, and the axis of the adjoining member.

The present invention further encompasses a method of constructing a tunnel from a multiplicity of slabs; the steps include (a) excavating at least a portion of a passage from earth; (b) assembling and installing a plurality of the slabs to form a hollow tube element of a predetermined maximal width, the hollow tube element defining a predetermined axis, and having front and rear portions, (c) joining another plurality of the slabs to the previously installed hollow tube element to form an adjoining hollow tube element similar to the previously installed hollow tube element, the adjoining hollow tube element defining a prearranged axis, (d) selectively orienting one of the hollow tube elements in relation to the other, so that one of the rear and front portions of the adjoining hollow tube element is juxtaposed with one of the rear end front portions of the previously installed hollow tube element, (e) selectively rotating one element with respect to the other, the axes subtending a prearranged angle with one another in dependence on the selected orientation of the adjoining tube element in relation to the previously installed tube element, and (f) repeating step (c) through (e) in relation to the last installed hollow tube element until a desired length of the tunnel is obtained, so that a spatial tunnel path may be preselected in accordance with successive selections of the prearranged angle between the axes of two adjoined tube elements.

BRIEF DESCRIPTION OF THE DRAWINGS

For a fuller understanding of the nature and objects of the invention, reference should be had to the following detailed description, taken in connection with the accompanying drawings, in which:

FIG. 4 corresponds to FIG. 2, and is to be used in conjunction with

FIG. 25 is a perspective view of an intermediate slab;

FIG. 26 is an exploded view of a portion of the interior of a hollow tube element, alternate slabs being omitted;

FIG. 27 corresponds to FIG. 26, but with the end slabs being inserted in the spaces shown in FIG. 26;

FIG. 28 is a partially exploded view of the interior of several sections of a hollow tube element, assembled to one another; and FIG. 29 shows a section of a tunnel from a sequence of assembled hollow tube elements, showing how a predetermined spatial path is obtained.

DESCRIPTION OF THE PREFERRED EMBODIMENTS

Figure 1:
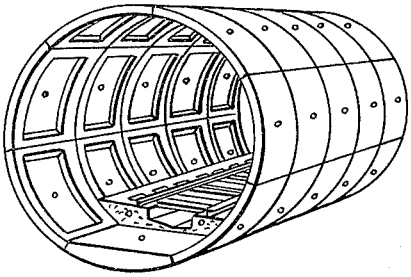
FIG 1 PRIOR ART
FIG. 1 shows a hollow tube element, according to the prior art.

Referring now to the drawings, the reinforced concrete pipe section of the prior art is shown in FIG. 1; it will be seen that it consists of a plurality of rings of equal width, sequentially joined to one another, each ring, in turn, consists of a multiplicity of slabs; in the example shown, there are 7 slabs per ring.

Figure 2:
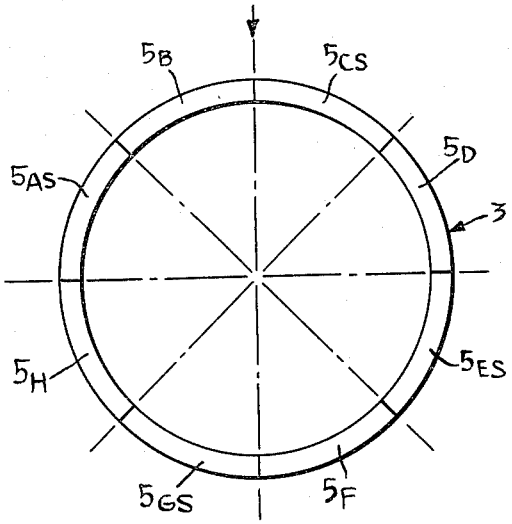
FIG. 2 is a side view of the tube element, according to the present invention.
Figure 3:
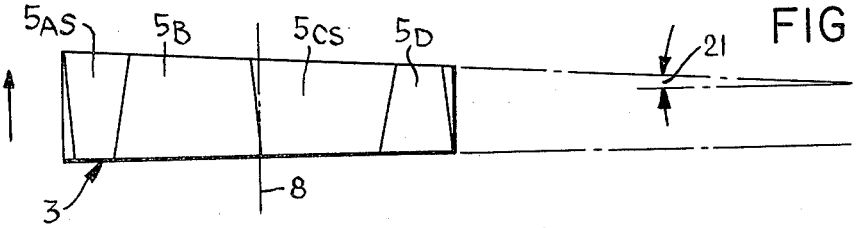
FIG. 3 is a top plan view of the hollow tube element shown in FIG. 2.
Figure 4:
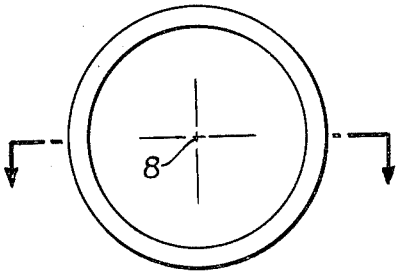
Figure 5:
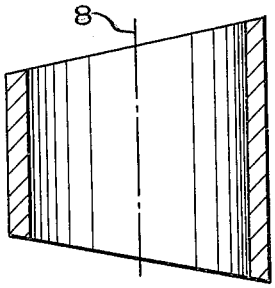
FIG. 5, which is a section along a mid-horizontal plane of FIG. 4.
Figure 6:
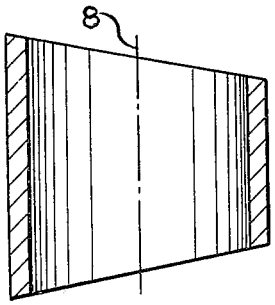
FIG. 6, which is also a section across the horizontal mid-plane of FIG. 4, but with the hollow element rotated by 180° around the central axis 8.

A side view of the hollow tube element, used as a building block for the construction of a tunnel, according to the present invention, is shown in FIG. 2, and a plan view thereof is shown in FIG. 3. It will be seen from FIG. 3, that the individual interconnected slabs, namely $5_{AS}$, $5_B$, and $5_{CS}$ are no longer of equal width, but differ dimensionally from each other, tapering off by an angle shown as "21" in FIG. 3. This permits the use of standardized hollow tube elements in tunnel construction, where the number of slabs 5 differing from one another in the entire tunnel never exceeds the number of slabs 5 differing from one another in merely a single hollow tube element 3. If two hollow tube elements, as shown in FIGS. 2 and 3, are joined together, it is possible to obtain a unit, as seen in plane view and in cross-section, as shown, for example, in FIG. 5. It will be realized that if such a unit is rotated about its axis 8 by 180°, a configuration as shown in FIG. 6 will be obtained. FIGS. 2 through 6 shows a truncated cone, each side of the cone making a prearranged angle with the axis of rotation, the cone ends being slanted at an angle to the axis of rotation, which angle differs from 90°.

Figure 7:
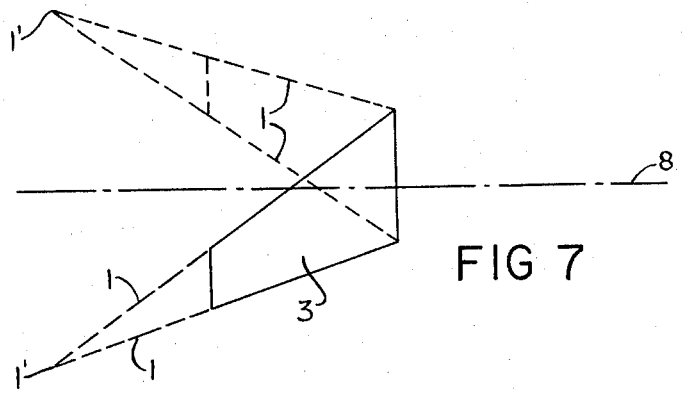
FIG. 7 is an elevational view of the generalized hollow tube element in the form of a truncated cone.
Figure 8:
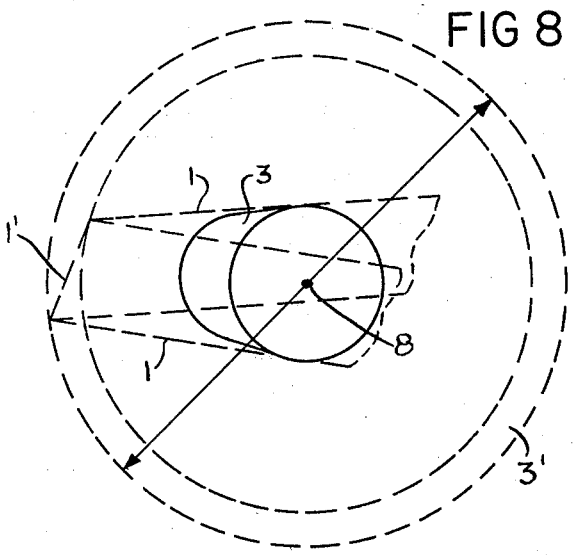
FIGS. 8 through 11 show the rotation of the conical truncated hollow tube element of FIG. 7, in side view, in successive 90° steps.
Figure 9:
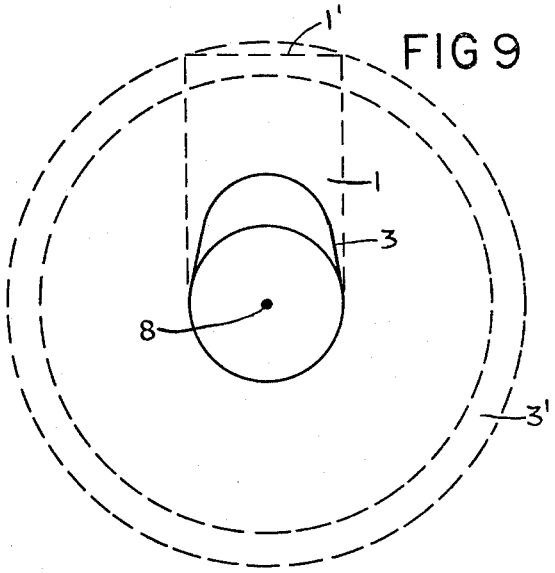
Figure 10:
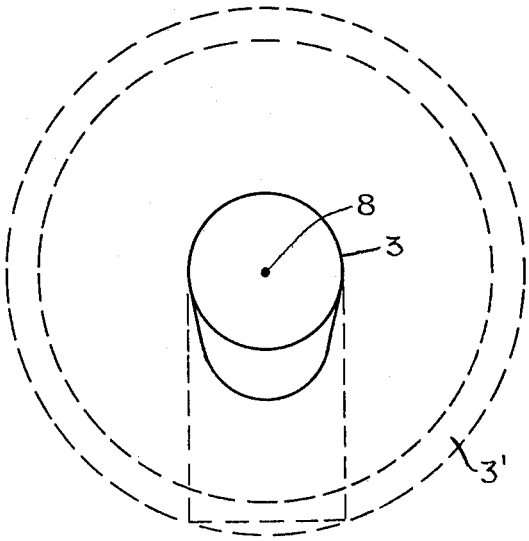
Figure 11:
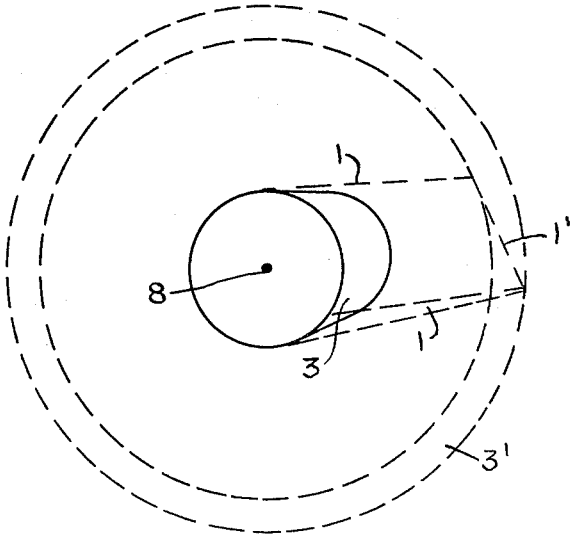

It will be appreciated that although the hollow element 3 has been shown as a portion of a cylinder in FIGS. 2 and 6, it may equally have any other configuration such as, for example, that of a hollow cone. Such a cone need not be symmetrical; a generalized elevational view of such a cone is shown in FIG. 7, the dotted outline of the cone 3 shown in FIG. 7 representing a position of the cone when rotated 180° about the axis 8 from the outline shown in full lines in FIG. 7.

Consider now the generalized case when the cone 3 is rotated about its axis 8, and when two plane surfaces of predetermined width abut opposite exterior surface portions of the cone tangentially, the planes 1 converging to a line 1'. If the cone 3 is now rotated 360° about a central axis 8, it will be seen that in the generalized case, the line 1' will descrive an annular surface 3', which has a predetermined outer diameter. This is shown in FIGS. 8 through 11. Convergence of the plane surface 1 is not obtained, other than at infinity, in the case of the hollow body 3 being a cylinder.

Although the invention can be defined with respect to a truncated cylinder or truncated cone, the use of plane surfaces disposed opposite one another, and tangential to surface portions of the hollow tube element, provides a very convenient and most generalized definition of the present invention. This definition includes hollow tube elements having non-circular cross-sections, such as, for example, polygonal cross-sections, or, specifically, an octagonal cross-section.

Figure 12:
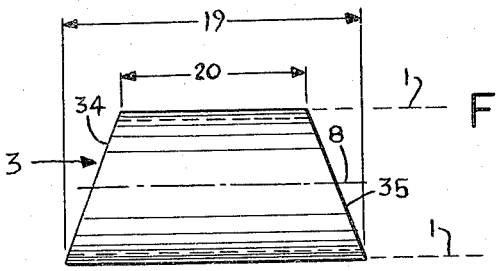
FIG. 12 is an elevational view of a hollow element in the shape of a truncated cone.
Figure 13:
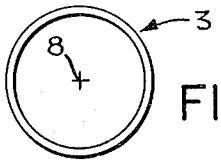
FIG. 13 is a side view of FIG. 12.
Figure 14:
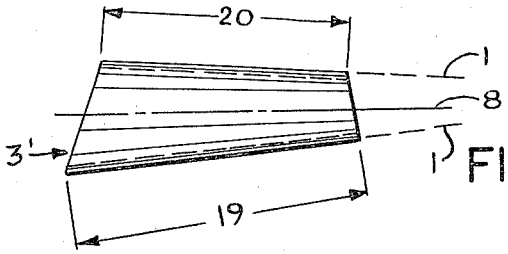
FIG. 14 is an elevational view of a generalized truncated conical hollow tube element.
Figure 15:
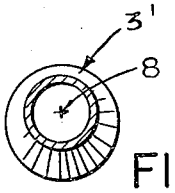
FIG. 15 is a side view in cross-section of FIG. 14.
Figure 16:
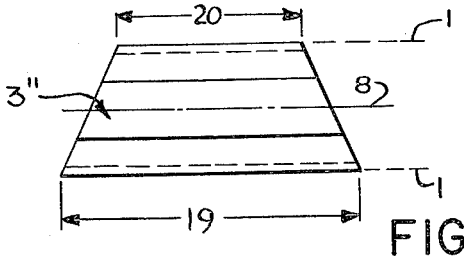
FIG. 16 shows a hollow tube element, having an octagonal cross-section, each end of the tube element having the octagonal cross-section being truncated at an angle to the central axis 8.
Figure 17:
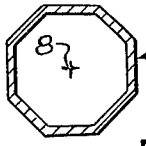
FIG. 17 is a cross-section of FIG. 16.
Figure 18:
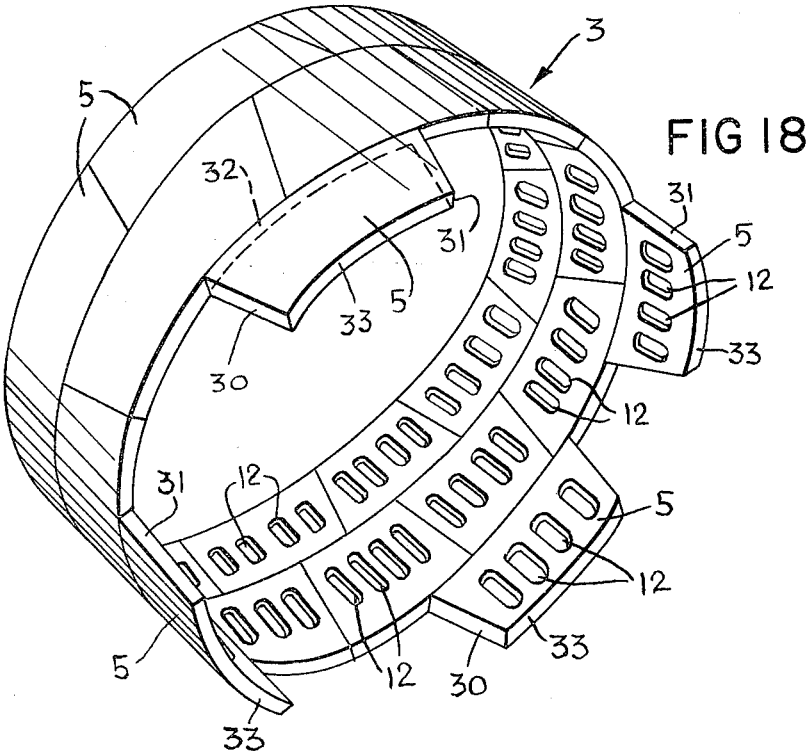
FIG. 18 shows a perspective view of a hollow tube element, according to the present invention.

FIGS. 12 and 13 show elevational and side views, respectively, of a truncated cylinder 3, FIGS. 14 and 15 show corresponding views of a truncated cone 3', and FIGS. 17 and 18 show a hollow element 3'', having an octagonal cross-section; all the configurations shown in FIGS. 12 through 17 are hollow tube elements, according to the present invention.

A specific embodiment of the hollow tube element, according to the present invention is shown in FIG. 18. It will be seen that the hollow tube element 3 is made up of a plurality of slabs 5, and that each slab 5 has a plurality of recesses 12 on the inner side thereof. Each slab 5 will be seen to have a pair of peripherally-facing end surfaces 30 and 31, and a pair of axially-facing surfaces 32 and 33.

Figure 19:
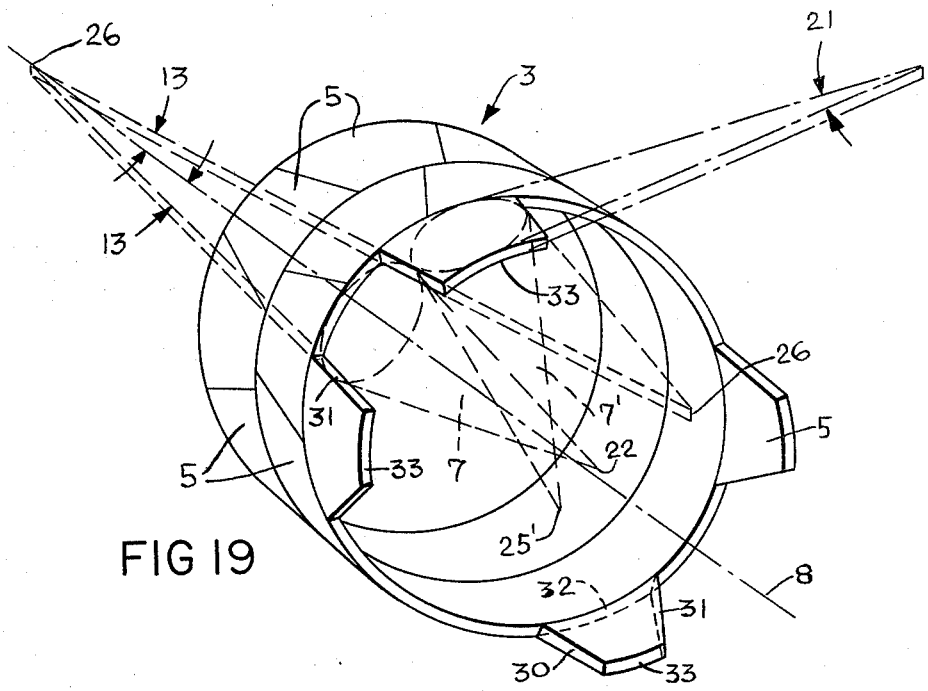
FIG. 19 is similar to FIG. 18, with non-essentiels details omitted, and additional parameters referenced.
Figure 20:
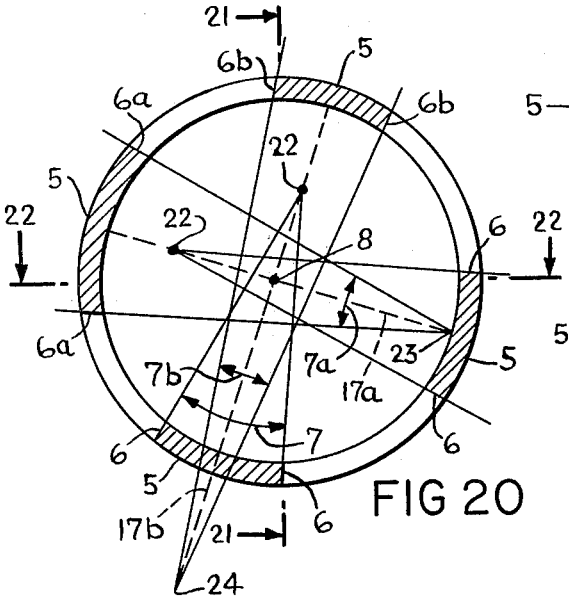
FIG. 20 is a side view corresponding to FIG. 18.

The geometry of the hollow tube element 3, according to the present invention, will be more clearly seen in FIG. 19. It will be seen that a cone 7 has been inscribed within two peripherally-facing end surfaces 30 and 31, spaced apart from one another by the width of the (non-illustrated) slab 5, and converge in an imaginary continuation of the end surfaces 30 and 31 to an imaginary line 26, the (non-illustrated) slab 5 having been purposely removed from FIG. 19, for the sake of clarity. The cone 7 also makes tangential contact with axially-facing end surfaces 32 and 33 of slabs 5, located immediately behind and ahead of the front row of slabs 5 in FIG. 19, as seen in an axial direction. It will be seen that an apex of the cone 7 is shown at 22 in FIG. 19; it should be noted that in the case shown, the apex 22 of the imaginary cone 7, although being disposed in a plane bisecting the peripherally-facing end surfaces 30 and 31 of a corresponding slab or slabs 5 as discussed, is not disposed at the center axis 8 of the hollow tube element 3, but outside thereof, as will be seen from FIG. 20.

The convergence (or divergence) of the peripherally-facing end surfaces 30 and 31 of the slab 5 in an axial direction, is measured by the half-angle 13, bisecting the angle between the peripherally-facing end surfaces 30 and 31 of the slab 5, while the acute angles subtended between the axially-facing end surfaces 32 and 33 of each slab 5 is determined by the angle 21, also seen in FIG. 3 yielding a line of intersection 37, best seen in FIG. 19.

The cone 7', inscribed between an axially-facing end surface of a slab 5, and the peripherally-facing end surfaces 30 and 31, of another slab 5, is similar, as shown in FIG. 19, to the cone 7 previously described herein, except the conicities of alternate cones, and therefore slabs 5 may differ from one another; it will be appreciated that the peripherally-facing end surfaces of alternate slabs converge in respective opposite directions, forming respective acute angles with one another. Adjoining slabs 5 need therefore not be identical, and this can best be seen from FIG. 20. The conicity of the slabs 5 is determined by the solid angle of the cone 7, which for the example shown in FIG. 19, has an apex 22, disposed between the center axis 8 of the hollow element 3, and its periphery. The apex of the cone can, however, also lie on the inner surface of the hollow element 3, as is shown by the apex 23, subtending tangential portions **6*a* and 6*b*, with a slab 5, or it can be disposed external to the circumference of the hollow element 3', as is shown, for example, by the apex 24 of the cone 7*b***.

In a preferred embodiment, the conicity of a first group of slabs is about 18°, and the conicity of a second group of slabs—the individual slabs of the second group, alternating with the individual slabs of the first group—is about 36°. Similarly, the acute angle of the first group of slabs has a range of about 0.1 to 3 degrees, and the acute angle of the second group of slabs has an acute angle of about 0.2 to 6 degrees.

Figure 21:
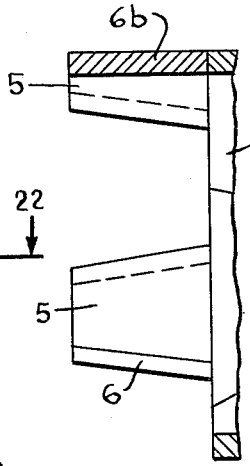
FIG. 21 is a cross-section of FIG. 20 along the line 21—21.
Figure 22:
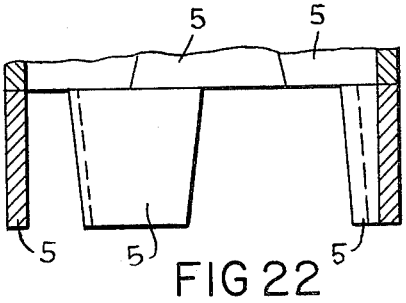
FIG. 22 is a cross-section of FIG. 20 along the line 22—22.
Figure 23:
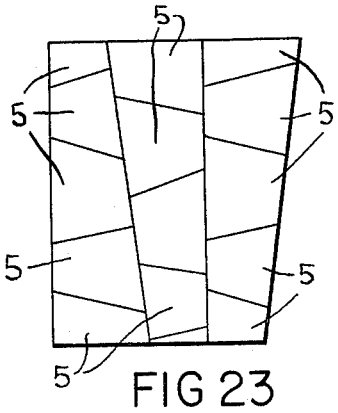
FIG. 23 is an elevational view of three hollow elements assembled so as to define a straight passage therethrough.

In each case, the cone 7 is generated about a respective axis **17*a*, 17*b*, or 17*c*, which bisects the peripheral end surfaces of respective slabs 5. A side view of the hollow element with alternate slabs 5 removed as shown in FIG. 21, sectioned along the lines 21—21 of FIG. 20, and a plan view of the hollow element 3, sectioned along the line 22—22, is shown in FIG. 22. A side view of several hollow elements, which are axially joined to one another, is shown in FIG. 23**.

Figure 24:
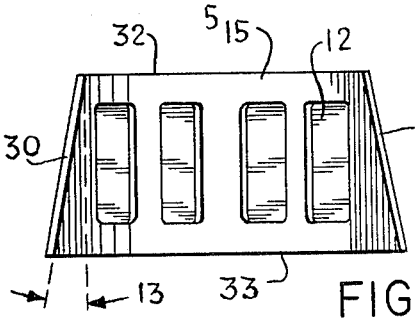
FIG. 24 is a view of an end slab.

As has already been mentioned, the conicity of the slabs 5 need not be uniform. In fact, it is advantageous if the end slabs are of a slightly different construction than the intermediate slabs, a typical end slab being shown in FIG. 24, and a typical intermediate slab being shown in FIG. 25.

FIG. 26 illustrated in an exploded side view of a hollow element 3, a row of slabs $5_{14}$, alternate spaces being left available for the subsequent insertion of the end slabs $5_{15}$.

FIG. 27 shows how the end slabs $5_{15}$ are inserted between the intermediate slabs $5_{14}$.

In FIG. 28, there is illustrated a further exploded view of a section of a hollow element, taken from its interior, there being four rows of slabs, namely rows n, n−1, n−2, and n−3. Recesses 12 in each slab will be clearly seen, as well as threaded holes 18 on opposite short sides of the rectangularly-shaped recess 12, serving to connect axially adjoining slabs 5. In FIG. 28, there will also be seen holes 9 and 10, which serve for injecting a sealing solution or material therethrough from the inner side of each hollow tube element 3, so as to permit sealing material to penetrate to the outside of the hollow tubular element 3, and to establish a static sealing between the hollow element 3 and the earth surrounding that element 3. These sealing holes are preferably located near critical T-junctions 11 of slabs 5, also clearly shown in FIG. 28.

FIG. 29 finally shows an assembled elevational view of a tunnel constructed with a plurality of adjoined or connected hollow tube or pipe elements 3. Each hollow member 3 has an inner surface defined by the rotation of a tetragon about one side thereof, that side defining the axis of rotation 8. Each hollow tubular member 3 also has two end surfaces 34 and 35 defining respective planes, which, as can be seen, are disposed at an angle 36 other than a right angle to the axis of rotation 8. Although this angle is shown exaggerated in FIG. 29, in practice, the deviation from a right angle is relatively small. Each hollow member 3 is designed to be secured to a similar adjoining member, and the members are then used for the construction of the tunnel.

The adjoining member is designed to be selectively oriented in relation to the hollow member, so that one of the hollow members is juxtaposed with one end of the adjoining member. Although each end surface 34 and 35 has really a (non-illustrated) elliptical contour, the deviation from a circle is so small, that an adjoining hollow member can be rotated with respect to a stationary hollow members by any desired angle, so that the respective axes of the members subtend an arbitrary angle with each other within the range of about 0 to 6 degrees, and point to a preselected arbitrary direction, for example, slanting upwardly or downwardly, or to the left, or to the right. Thus, the tunnel can be made to trace any desired spatial curve, the direction of the tunnel axis changing in discrete steps.

The present invention also encompasses a tunnel construction; a multiplicity of interconnected hollow members 3 define a tunnel passage; and each hollow member 3 defines a predetermined axis 8, and includes means for selectively orienting an adjoining hollow member 3 in relation to the hollow member 3, so that the axis 8 of the hollow member 3 subtends a prearranged angle with the axis 8 of the adjoining member in dependence of the selected orientation of the adjoining member 3, thus permitting pres-selection of a spatial tunnel path, in accordance with successive selections of the prearranged angle between the axis 8 of the hollow member 3, and the axis 8 of the adjoining hollow member 3.

The present invention further encompasses a method of constructing a tunnel from a multiplicity of slabs; the steps include (a) excavating at least a portion of a passage from earth, (b) assembling and installing a plurality of slabs 5 to form a hollow tube element 3 of a predetermined maximal width, the hollow tube element 3 defining a predetermined axis 8 and having front and rear portions, (c) joining another plurality of the slabs 5 to the previously installed hollow tube element 3 to form an adjoining hollow tube element 3 similar to the previously installed hollow tube element 3, the adjoining hollow tube element 3 defining a prearranged axis 8, (d) selectively orienting one of the hollow tube elements 3 in relation to the other, so that one of the rear and front portions of the adjoining hollow tube elements 3 is juxtaposed with one of the rear end front portions of the previously installed hollow tube element 3, (e) selectively rotating one hollow tube element 8 with respect to the other, their axes 8 subtending a prearranged angle with one another in dependence on the selected orientation of the adjoining tube element 3, in relation to the previously installed tube element 3, and (f) repeating steps (c) through (e) in relation to the last installed hollow tube element 3, until a desired length of the tunnel is obtained, so that a spatial tunnel path may be preselected in accordance with successive selections of the prearranged angle between the axes of two adjoined tube elements.

We wish it to be understood that we do not desire to be limited to the exact details of construction shown and described, for obvious modifications will occur to a person skilled in the art.

Having thus described the invention, what we claim as new and desire to be secured by Letters Patent, is as follows:

1. A hollow tube element of a predetermined maximal width and defining a predetermined axis, adapted to be secured to an adjoining hollow tube element for use as building blocks for the construction of a tunnel passage, and being rotatable about its axis through an arbitrary angle relative to the adjoining tube element, for preselecting a spatial tunnel path, comprising in combination:

a plurality of interconnected slabs, each slab differing dimensionally from at least some other slabs, said slabs including first and second groups, each slab having two peripheral end surfaces forming an acute angle with one another, and two axial end surfaces disposed opposite one another, the peripheral end surfaces of said first and second groups of slabs converging in respective opposite directions to first and second lines of intersection, the axial end surfaces of each slab of each tunnel element being disposed in two respective planes which converge to a third line of intersection, first and second predetermined conicities with respect to a radial direction of a corresponding slab of said first and second groups, respectively, being defined by respective imaginary first and second cones, each conicity having a cone axis passing through said predetermined axis, and having a circumferential surface portion inscribed between the two peripheral end surfaces, and one of said axial end surfaces of a corresponding slab, whereby only a limited and relatively small even number of slabs of different respective dimensions are required to form a plurality of respective tube elements so as to construct said tunnel passage from said tube elements.

2. A hollow tube element as claimed in claim 1, wherein said hollow tube element is a cylinder.

3. A hollow tube element as claimed in claim 1, wherein said hollow tube element is a truncated cone.

4. A hollow tube element as claimed in claim 1, wherein said predetermined axis is a central axis.

5. A hollow tube element as claimed in claim 1, wherein said hollow tube element has a polygonal cross-section.

6. A hollow tube element as claimed in claim 1, wherein the adjoining tube element is similar to said hollow tube element.

7. A hollow tube element as claimed in claim 1, wherein the number of slabs differing from one another in the adjoining tube element is at most equal to the number of slabs differing from one another in said hollow tube element.

8. A hollow tube element as claimed in claim 1, wherein said first and second conicities are substantially equal.

9. A hollow tube element as claimed in claim 1, wherein the apex of one of said cones is located outside said hollow tube element, and the apex of the other of said cones is located inside said hollow tube element.

10. A hollow tube element as claimed in claim 1, wherein the apices of said cones are located substantially on the inner circumference of said hollow tube element.

11. A hollow tube element as claimed in claim 1, wherein the first predetermined conicity subtends a solid angle of about 18°, and the second predetermined conicity subtends a solid angle of about 36°.

12. A hollow tube element as claimed in claim 1, wherein the acute angle of a slab of said first group of slabs is within the range of 0.1 to 3 degrees, and the acute angle of said second group of slabs is within the range of 0.2 to 6 degrees.

13. A hollow tube element as claimed in claim 1, wherein each of said slabs has a plurality of recessed on an inner side thereof.

14. A hollow tube element as claimed in claim 1, wherein each of said slabs has a plurality of corners and an opening near at least one of the corners, whereby hardenable material in liquid form can be extruded from the interior of said hollow tube element towards its exterior, so as to form a securing link between said hollow tube element and earth surrounding said hollow tube element after installation of said hollow element, and following hardening of said material.

15. A hollow tube element as claimed in claim 1, wherein each slab has threaded holes on opposite axial sides thereof arranged so that upon rotation of said tube element by an integral multiple of 180°, threaded holes of juxtaposed tube elements are aligned.

* * * * *